US007604515B2

(12) United States Patent
Siemon et al.

(10) Patent No.: US 7,604,515 B2
(45) Date of Patent: Oct. 20, 2009

(54) MODULAR CONNECTOR WITH REDUCED TERMINATION VARIABILITY

(75) Inventors: John A. Siemon, Woodbury, CT (US); Randy J. Below, Cheshire, CT (US); Brian Celella, Southington, CT (US); James A. Frey, Woodbury, CT (US); Maxwell K. Yip, Trumbull, CT (US); Vinicio Crudele, Watertown, CT (US); Joseph M. Favale, Watertown, CT (US); Marc J. Pardee, Waterbury, CT (US)

(73) Assignee: The Siemon Company, Watertown, CT (US)

( * ) Notice: Subject to any disclaimer, the term of this patent is extended or adjusted under 35 U.S.C. 154(b) by 0 days.

(21) Appl. No.: 11/947,966

(22) Filed: Nov. 30, 2007

(65) Prior Publication Data

US 2008/0160837 A1 Jul. 3, 2008

Related U.S. Application Data

(60) Provisional application No. 60/872,075, filed on Dec. 1, 2006, provisional application No. 60/920,768, filed on Mar. 29, 2007.

(51) Int. Cl.
*H01R 24/00* (2006.01)

(52) U.S. Cl. ..... 439/676; 439/941

(58) Field of Classification Search ..... 439/676, 439/941

See application file for complete search history.

(56) References Cited

U.S. PATENT DOCUMENTS 4,412,715 A 11/1983 Bogese, II
5,478,252 A 12/1995 Lecomte et al.
5,692,925 A 12/1997 Bogese, II
5,905,637 A 5/1999 Su
5,961,354 A * 10/1999 Hashim ..... 439/676
5,967,801 A 10/1999 Martin et al.
5,971,812 A 10/1999 Martin
5,999,400 A 12/1999 Belopolsky et al.
6,083,047 A 7/2000 Paagman
6,089,923 A * 7/2000 Phommachanh ..... 439/676
6,109,971 A * 8/2000 Vadlakonda ..... 439/620.03
6,113,400 A 9/2000 Martin et al.
6,116,943 A 9/2000 Ferrill et al.
6,194,652 B1 2/2001 Ivan (Continued)

OTHER PUBLICATIONS

International Search Report, PCT/US2007/024632, May 14, 2008.

*Primary Examiner*—Truc T Nguyen
(74) *Attorney, Agent, or Firm*—Cantor Colburn LLP

(57) ABSTRACT

A telecommunications connector assembly including a cable having a first pair of twisted wires and a second pair of twisted wires; a first connector having a first substrate having a first termination area, the first pair of twisted wires being electrically terminated on a first side of the first substrate, the second pair of twisted wires being electrically terminated on a second side of the first substrate, the second side opposite the first side; a second connector having a second substrate having a second termination area, the second pair of twisted wires being electrically terminated on the first side of the second substrate, the first pair of twisted wires being electrically terminated on the second side of the second substrate, the second side opposite the first side.

19 Claims, 9 Drawing Sheets

U.S. PATENT DOCUMENTS 6,293,818 B1 9/2001 Kim et al.
6,296,532 B1 * 10/2001 Harting et al. ..... 439/807
6,305,950 B1 * 10/2001 Doorhy ..... 439/76.1
6,354,865 B1 3/2002 Bogese
6,371,793 B1 * 4/2002 Doorhy et al. ..... 439/404
6,379,157 B1 * 4/2002 Curry et al. ..... 439/676
6,380,485 B1 * 4/2002 Beaman et al. ..... 174/88 R
6,464,541 B1 * 10/2002 Hashim et al. ..... 439/676
6,527,594 B1 3/2003 Korsunsky et al.
6,592,395 B2 * 7/2003 Brown et al. ..... 439/405
6,617,939 B1 9/2003 Vermeersch
7,186,148 B2 3/2007 Hashim
7,201,618 B2 4/2007 Ellis et al.
7,474,737 B2 1/2009 Crudele et al.
2004/0116081 A1 6/2004 Crudele et al.
2004/0216914 A1 11/2004 Vexler et al.
2006/0131056 A1 6/2006 Hackman
2009/0149082 A1 6/2009 Leubner

* cited by examiner

PRINTED CIRCUIT BOARD

MODULAR CONNECTOR WITH REDUCED TERMINATION VARIABILITY

CROSS-REFERENCE TO RELATED APPLICATIONS

This application claims the benefit of U.S. provisional patent application Ser. No. 60/872,075 filed Dec. 1, 2006, the entire contents of which are incorporated herein by reference, and this application claims the benefit of U.S. provisional patent application Ser. No. 60/920,768 filed Mar. 29, 2007, the entire contents of which are incorporated herein by reference

BACKGROUND

As telecommunications applications require higher frequency performance and more controlled performance per standards such as IEEE 802.3 an 10 GBASE-T, ISO/IEC 11801 Ed 2, IEC 60603-7-41, ANSI/TIA/EIA-568-B, etc. . . . , the performance of modular plug cords (e.g., twisted pair cable terminated to modular plugs) becomes more critical. Connectors (e.g., outlets or jacks having printed circuit board (PCB), flex circuits or lead frame connections to various terminal blocks) are designed and defined by their performance related to the range of electrical plug performance they are tested with (as defined in TIA and IEC documents and others). The outlet performance can be improved by limiting the range/variability of plugs (or modular plug cords including two plugs) the outlet is mated with. Since most manufacturers sell their connectors with their own modular plug cords, one can improve performance by tuning to and reducing the variability of cord production, while complying with industry standards (i.e., TIA or ISO/IEC limits).

Telecommunications connectors are often used with multi-pair cable. The wire lay (pairs of wires twisted around each other over a predetermined length) results in an orientation of pairs in one end that is a mirror image of the other end. The inherent nature of twisted pair cable results in a mirror image pattern when you cut a piece of cable to terminate plugs. Existing standard plug designs have one set of termination pattern that then requires one end or both ends of the cable to cross pairs to align them properly for termination. This crossing or manipulation of pairs or untwisting of pairs results in significant variation by adding an uncontrolled crosstalk element.

In existing plugs, the front-end contacts pierce individual conductors in the cable and make contact with the inner wire. The contact is set within the plug body. However, there is variability in where the contact sits and the location of the twisted pairs, which leads to electrical transmission variation as well as dimensional variation. This crimp height variation causes multiple problems, specifically, undetermined coupling from the surface area of the plates, as well as inconsistent mating to outlets. Inconsistent crimp height can arrange the mated outlet contacts in undesirable positions causing various levels of crosstalk that cannot be appropriately compensated for.

Additionally, in existing plugs, the pairs within the cable need to be untwisted to access the front-end contacts. The untwisting of the pair is typically inconsistent and results in crossed pairs causing various levels of crosstalk that cannot be appropriately compensated for.

Thus, there is a need in the art for a telecommunications connector having reduced termination variability to improve performance (e.g., crosstalk reduction) of the mated connectors.

SUMMARY

Embodiments of the invention include a telecommunications connector assembly including a cable having a first pair of twisted wires and a second pair of twisted wires; a first connector having a first substrate having a first termination area, the first pair of twisted wires being electrically terminated on a first side of the first substrate, the second pair of twisted wires being electrically terminated on a second side of the first substrate, the second side opposite the first side; a second connector having a second substrate having a second termination area, the second pair of twisted wires being electrically terminated on the first side of the second substrate, the first pair of twisted wires being electrically terminated on the second side of the second substrate, the second side opposite the first side.

DETAILED DESCRIPTION

Figure 1:
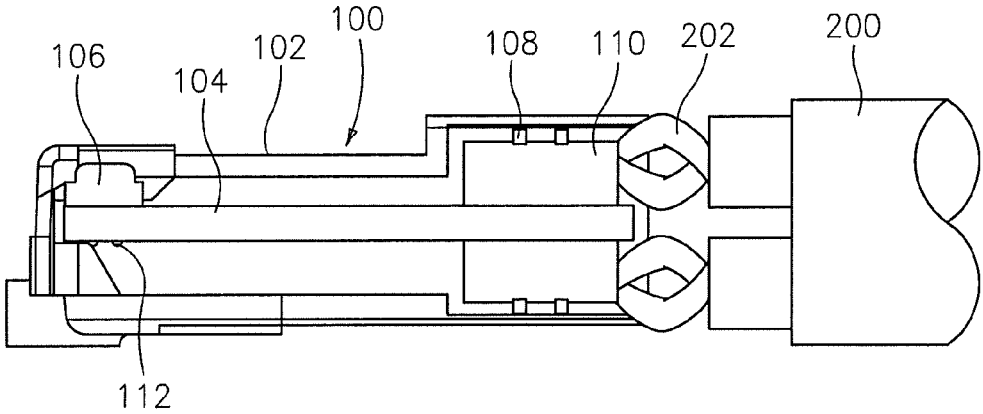
FIG. 1 is a side view of an exemplary plug in embodiments of the invention.

FIG. 1 is a side view of an exemplary plug 100 connected to a cable 200. Cable 200 includes four twisted pairs of wires 202. It is understood that embodiments of the invention may be used with cables having a different number of twisted pairs, and the invention is not limited to cables having four twisted pairs of wires. The plug 100 includes a plug housing 102 dimensioned to mate with existing modular outlets. Plug housing 102 may be an RJ-45 type plug, but may have different configurations.

Plug housing 102 contains a substrate 104 which establishes an electrical connection between plug contacts 106 and wire contacts 108. The wire contacts 108 may be positioned on a contact carrier 110. The substrate 104 may be a printed circuit board, flexible circuit material, multi-dimensional PCB, etc. having traces 105 (FIG. 6) therein for establishing electrical connection between plug contacts 106 and wire contacts 108. As described in further detail herein, the substrate 104 may include compensation elements for tuning electrical performance of the plug 100 (e.g., NEXT, FEXT, return loss, balance). In alternate embodiments, some or all of the plug contacts 106 and wire contacts 108 are part of a lead frame, eliminating the need for substrate 104.

Figure 2:
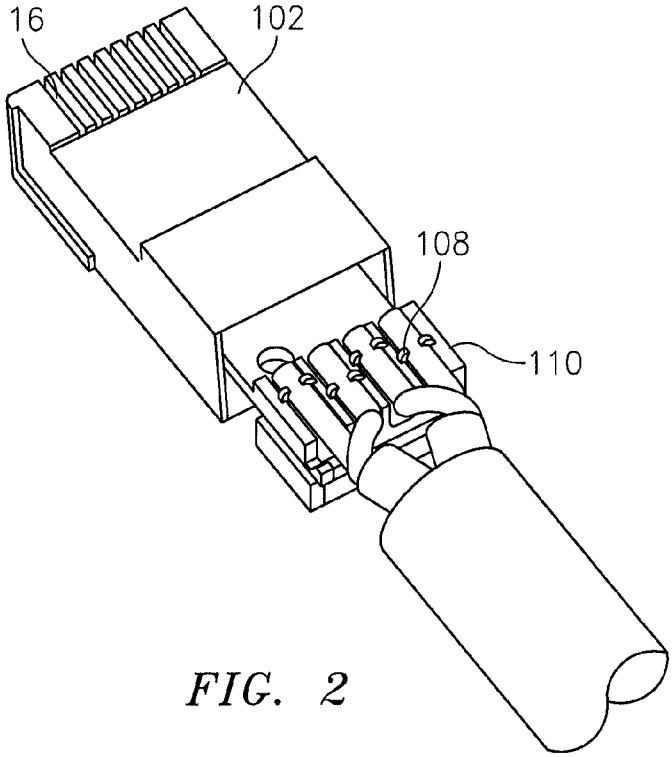
FIG. 2 is a perspective view of the plug of FIG. 1.

Plug contacts 106 have a press fit tail 112 that is received in a plated through hole 114 in substrate 104. Traces on substrate 104 establish electrical connection between plated through hole 114 and wire contacts 108. Plug contacts 106 extend through slots 116 (FIG. 2) in plug housing 102 to establish contact with outlet contacts (not shown) when plug 100 is mated with an outlet (not shown). In alternate embodiments, the plug contacts 106 are soldered in substrate 104. The plug contacts 106 or 108 may have press fit tails, solder tails, compliant pin, mechanically secured tails, or other connection-types for establishing electrical and mechanical connection in plated through holes 114 or 107 or on surface mount pads.

Wire contacts 108 include press fit tails that extend through contact carrier 110 and engage plated through holes 107 (FIG. 6) in substrate 104 beneath contact carrier 110. Four wire contacts 108 extend from a first surface of the substrate and four wire contacts 108 extend from a second surface of the substrate 104. The arrangement of the wire contacts on the substrate 104 allows the twisted wire pairs to be terminated to the wire contacts 108 without crossing or manipulating wire pairs from their original position on either end of a modular plug cord or other assembly. This feature is described in further detail herein with reference to FIGS. 5-8.

Figure 3:
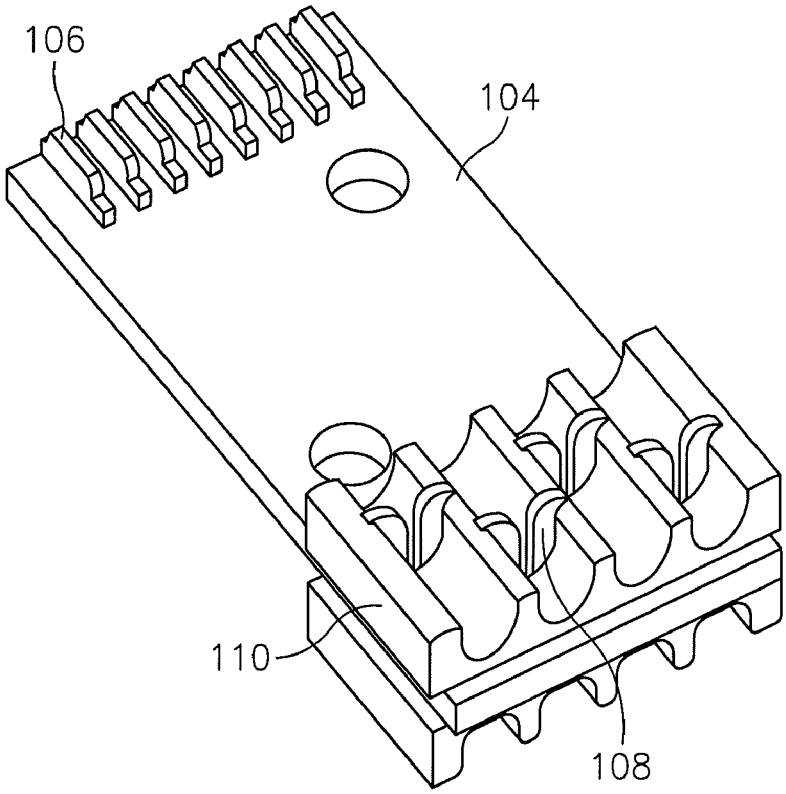
FIG. 3 is a perspective view of components of the plug of FIG. 1.
Figure 4:
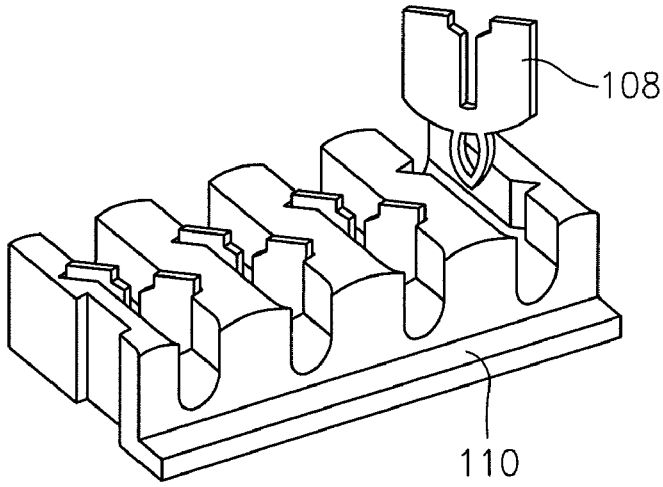
FIG. 4 is a perspective view of a contact carrier and wire contacts in an alternate embodiment.

FIG. 3 illustrates the substrate 104, plug contacts 106, contact carriers 110 and wire contacts 108 without the twisted wire pairs. In FIG. 3, the wire contacts 108 are insulation displacement contacts. The insulation displacement contacts 108 are positioned to be perpendicular to a longitudinal axis of the wire from the twisted wire pair 202. FIG. 4 shows an alternate embodiment where the insulation displacement contacts 108 are positioned at an oblique angle (e.g. 45 degrees) relative to a longitudinal axis of the wire from the twisted wire pair 202. The wire contacts 108 do not have to be in a line on the same plane, thereby allowing a wider range of wire gages. In alternate embodiments, the insulation displacement contacts are insulation piercing contacts.

Figure 5:
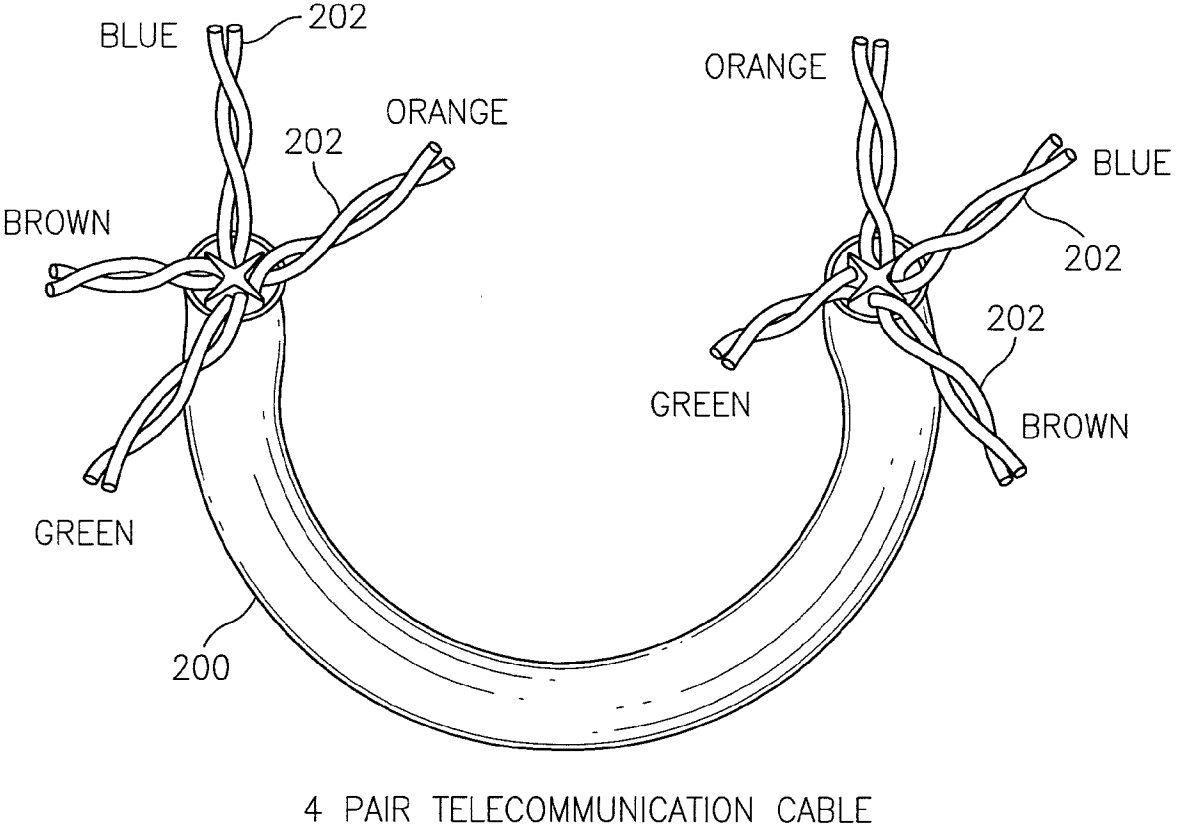
FIG. 5 illustrates an exemplary cable.

FIG. 5 illustrates a four pair telecommunications cable 200 having twisted pairs of wires 202. As is typical in the art, the pairs are colored with a solid color wire twisted with another wire having the same color and the color white (e.g., one twisted pair has a blue wire and a blue/white wire twisted). The colors of each pair are shown in FIG. 5 for ease of explanation. Embodiments of the invention are not limited to particular wire colors or pair counts.

Figure 7:
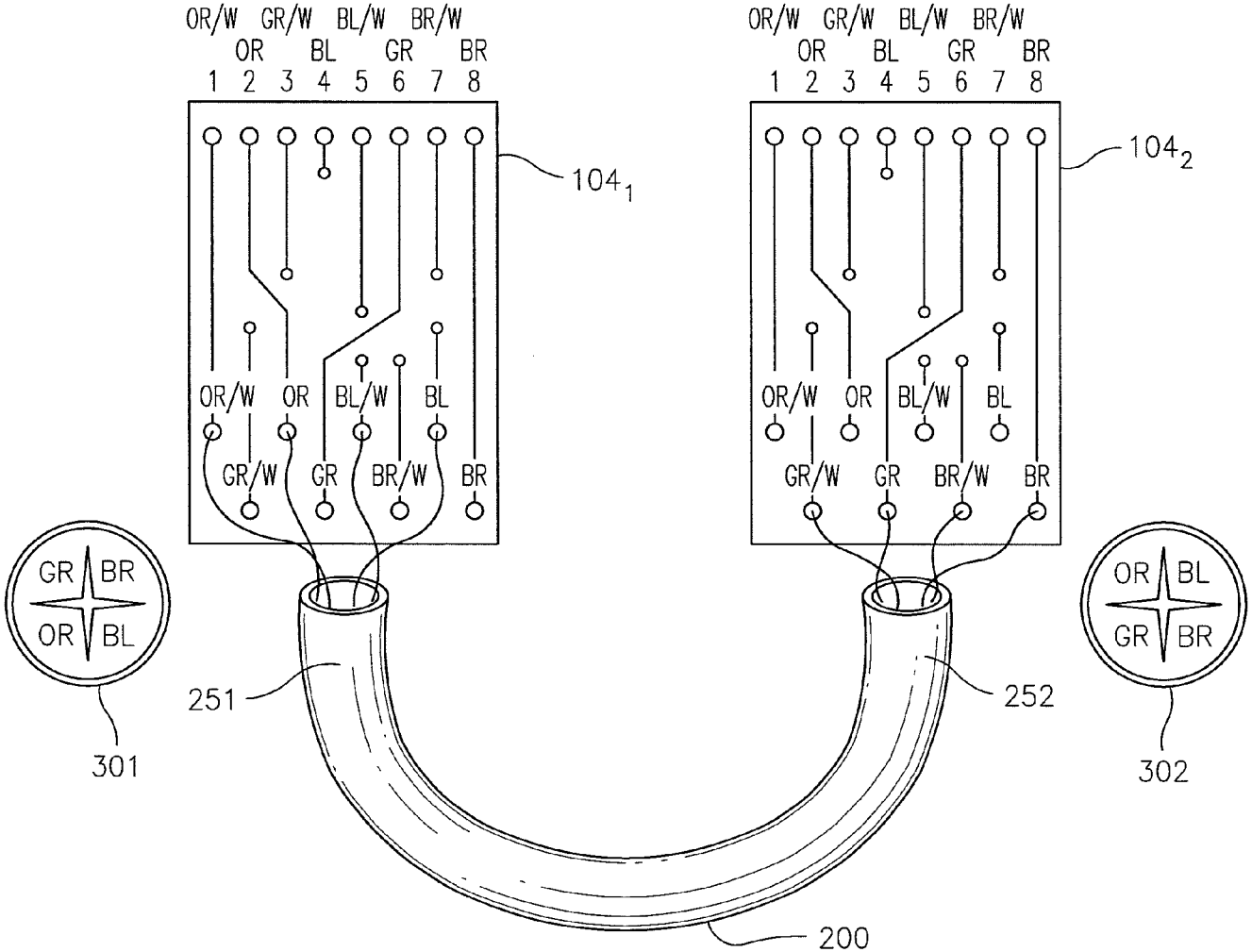
FIG. 7 illustrates two pairs of wires terminated at a top side of two substrates without crossing twisted pairs.
Figure 8:
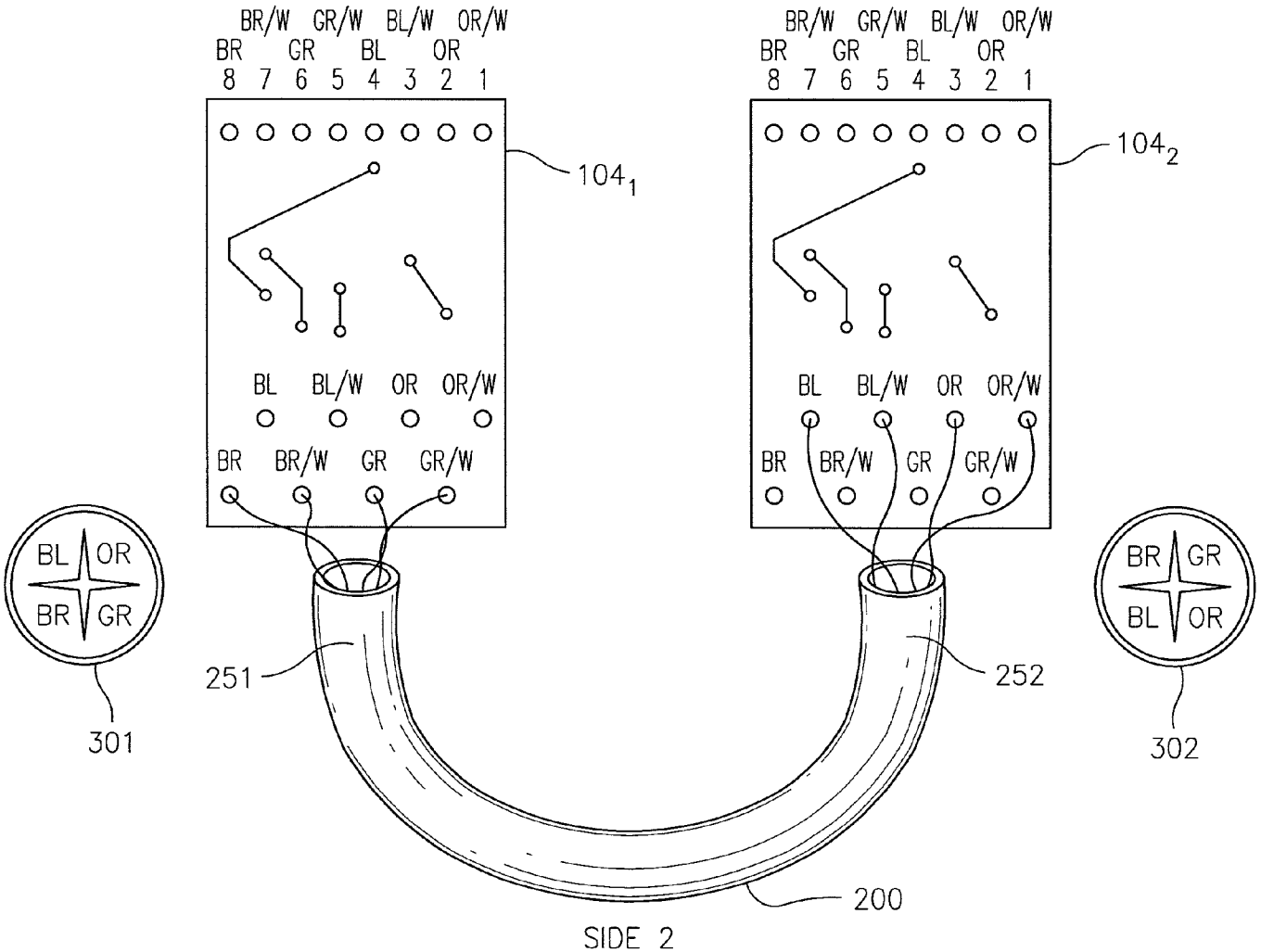
FIG. 8 illustrates two pairs of wires terminated at a bottom side of two substrates.

As shown in FIGS. 5, 7 and 8, the opposite ends of the cable 200 are mirror images of each other, with respect to the location of the wire pairs. This orientation of the wire pairs in the cable has typically led to crossing pairs of wires when the cable is terminated to a connector. Typically, if pairs are not crossed when terminated at one end of cable 200, then the pairs must be rearranged and crossed at the other end of the cable. This is due to the fact that conventional connectors are identical at each end of the cable, but the wire pair locations are different at each end of the cable. In this conventional arrangement, if wire pairs at one end are not crossed, the wire pairs at the other end of the cable will necessarily be crossed. Embodiments of the invention eliminate this problem.

Figure 6:
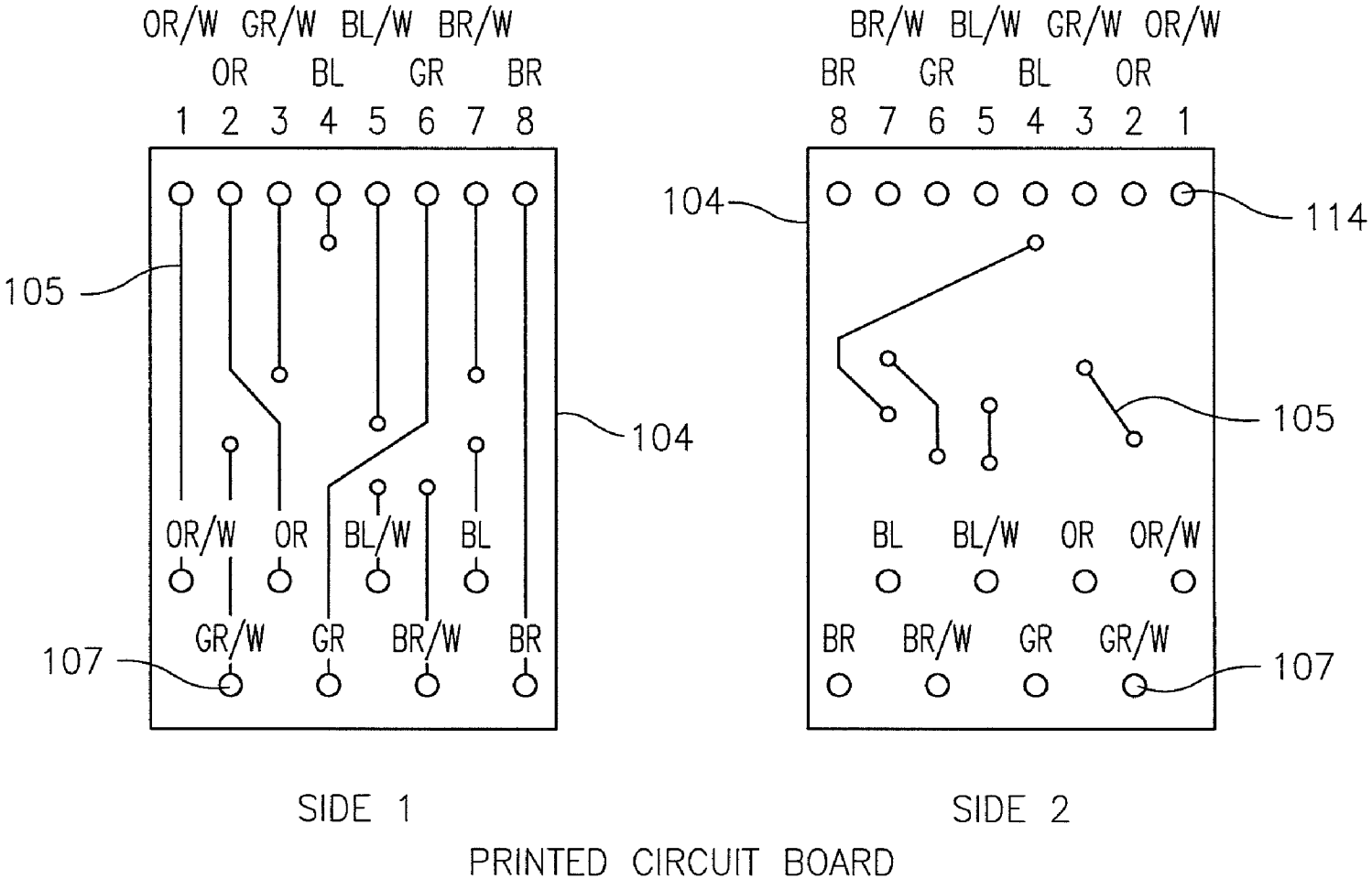
FIG. 6 illustrates an exemplary circuit board.

FIG. 6 illustrates both sides of a printed circuit board 104 in embodiments of the invention. Traces 105 establish electrical connection between plated through holes 107 and plated through holes 114. Plated through holes 107 receive press fit tails of wire contacts 108. Plated through holes 114 receive press fit tails of plug contacts 106. The pair locations are represented by the designators OR/W (orange white wire) and OR (orange wire), BL/W (blue white wire) and BL (blue wire), GR/W (green white wire) and GR (green wire), and BR/W (brown white wire) and BR (brown wire). Reference to the "blue pair", for example, refers to the blue and blue/white wire. As known in the art, a pair of wires is twisted about each other in cable 200.

FIG. 7 illustrates termination of cable wire pairs 202 at each end of the cable to a first side of two substrates, first substrate $\mathbf{104}_1$ used in a first connector and second substrate $\mathbf{104}_2$ used in a second connector. The position of the cable pairs within the cable 200 is depicted at 301 and 302. FIG. 7 shows the first side (e.g., a top side) of both substrates $\mathbf{104}_1$ and $\mathbf{104}_2$ at each end of the cable. As shown, at end 251, the orange pair of wires and the blue pair of wires are terminated to wire contacts 108 on the top side of substrate $\mathbf{104}_1$. The green pair of wires and brown pair of wires are terminated to wire contacts 108 at the top side of substrate $\mathbf{104}_2$. This is consistent with the natural wire location of the wire pairs in the cable 200 as shown at 301 and 302.

FIG. 8 illustrates termination of cable wire pairs 202 at each end of the cable to a second side of two substrates $\mathbf{104}_1$ and $\mathbf{104}_2$. The positions of the cable pairs within the cable 200 is depicted at 301 and 302 as viewed from the second side of the board. FIG. 8 shows the second side (e.g., a bottom side) of both substrates $\mathbf{104}_1$ and $\mathbf{104}_2$ at each end of the cable. As shown, at end 251 the brown pair of wires and the green pair of wires are terminated to wire contacts 108 on the bottom side of substrate $\mathbf{104}_1$. The blue pair of wires and orange pair of wires are terminated at the bottom side of substrate $\mathbf{104}_2$. This is consistent with the natural wire location of the wire pairs in the cable 200 as shown at 301 and 302.

The exemplary embodiments described above use a single substrate 104 with different wire contact locations for each end of the cable. In other words, the wire termination configurations on each end of the cable are different so as to prevent crossing of wire pairs. Wire contacts 108 are positioned on the top of substrate $\mathbf{104}_1$ for the orange and blue pairs (FIG. 7). Wire contacts 108 are positioned on the bottom of substrate $\mathbf{104}_1$ for the brown and green pairs (FIG. 8). The opposite arrangement is used on substrate $\mathbf{104}_2$.

The embodiment of FIGS. 7 and 8 use the same substrate 104 on each end of the cable 200. In alternate embodiments, two different substrates are used, one for each end of the cable, with differently configured traces to map the wires in the cable to the plug contacts without the need to cross or reposition wire pairs at either end of the cable. In yet further embodiments, single substrates are used having multiple sets of traces embedded in 2 or more layers. The substrate includes a first set of traces for use with a first cable end and a second set of traces for use with the other cable end.

By positioning the wire contacts for a pair of wires on opposite sides of the substrate on opposite ends of the cable, the wire pairs in cable 200 do not need to be crossed at one end of the cable. For example, the blue wire pair is terminated to the top of substrate $\mathbf{104}_1$ and terminated to the bottom of substrate $\mathbf{104}_2$. This is consistent with the position of the blue wire pair at each end of the cable 200. Thus, the wire pairs 202 do not need to be crossed and wire pair untwist is minimized as well. This results in much more predictable wire termination and reduces variability in electrical performance of the modular plug cords because wire termination is more predictable. When the electrical performance of the modular plug cords has less variation, it is easier to compensate for electrical performance (e.g., NEXT, FEXT) either on substrate 104 or elsewhere in the channel (e.g., outlet, cable).

Further, the design allows cable having a larger diameter conductors to be terminated to the plug. Existing plugs have a fixed width and these plugs are typically limited to terminating 24 AWG conductors. Because the plug embodiment shown has the cable centered about the substrate with two wire pairs on top and two wire pairs on the bottom, the plug can terminate 23 and 22 AWG conductors 202. Thus, exemplary embodiments can terminate cables having conductors 202 in a range of 27 AWG to 22 AWG.

Figure 12:
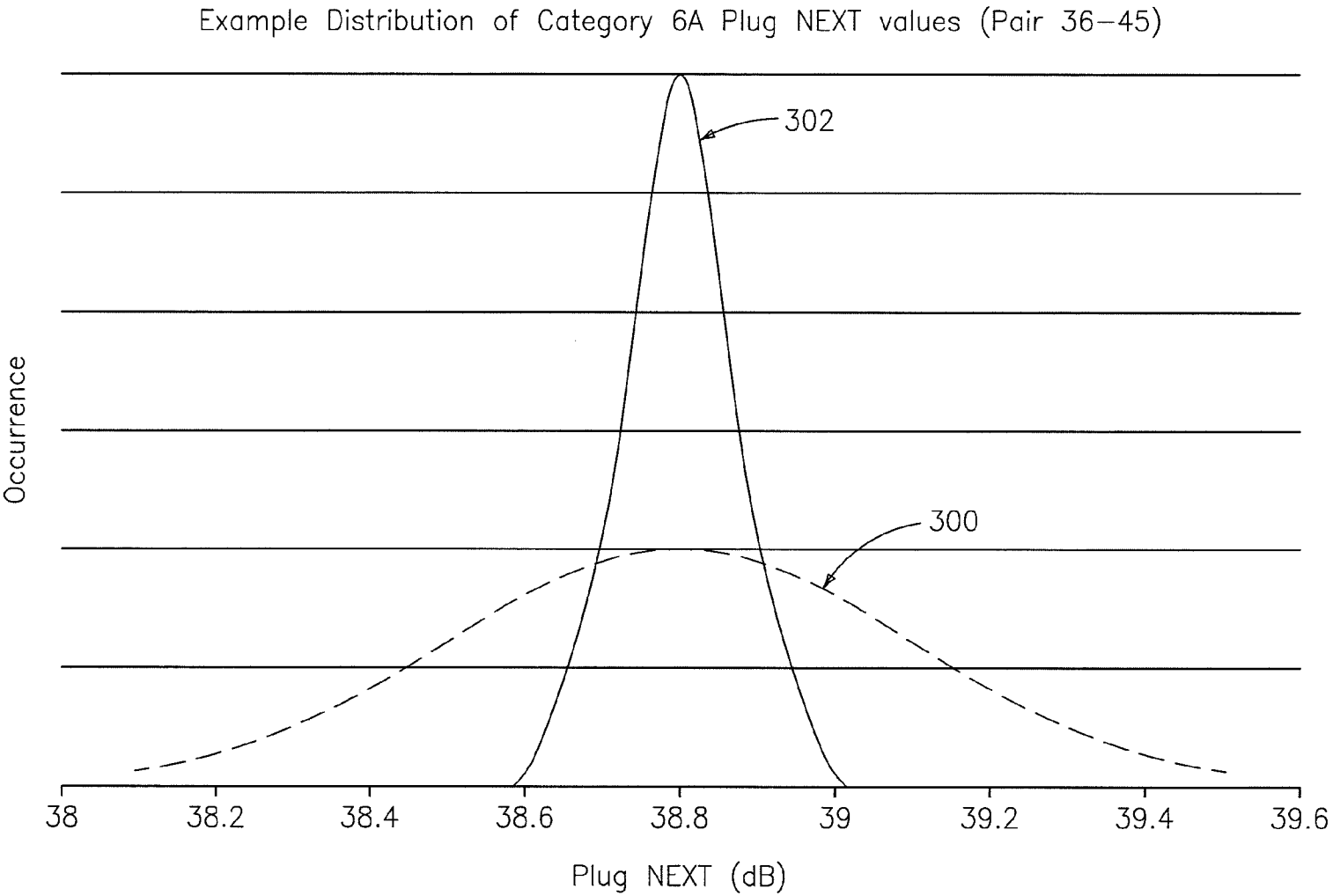
FIG. 12 is a plot of plug performance versus frequency.

The electrical performance of the plug may be tuned using features on the substrate 104 such as circuit traces. The tuning of the plug may be performed to address electrical performance characteristics such as near end crosstalk (NEXT), return loss, far end crosstalk (FEXT), and balance, etc. Because the wire pairs do not need to be untwisted or crossed to terminate the wire pairs, plug 100 can be tuned more precisely (lower variation) and more accurately (targeted performance level within specifically allowed range). FIG. 12 illustrates plots of the distribution of plug NEXT values illustrating an acceptable plug performance range 300 and performance for plug 100 as plot 302. The graphs show the narrowed band of plug NEXT values achievable for plug 100, which equates to a more predictable and controlled component. FIG. 12 is one example of a specific case, illustrating Category 6A allowed plug NEXT range for the 36-45 pair combination. The same concept can be expanded to other pair combinations for other Categories, and other transmission parameters. The acceptable plug performance range 300 may be defined by a standard such as Category 5e, 6, 6A, etc. . . . The performance may be measured for a variety of electrical parameters such as NEXT, FEXT, return loss, balance, etc. The enhanced performance results in a higher total channel performance per cost. This also allows the outlet that mates with the plug to be less complex as the plug is focused at a certain performance level. Accordingly, the outlet need only have electrical performance targeted for a particular plug performance, rather than a wide range of plug performance. Given the ease of termination and lack of wire pair manipulation, the plug may be terminated in the field by an installer and still provide targeted performance.

Further, the ability to tune electrical performance of each plug on a modular plug cord allows the plug performance characteristics to be adjusted to enhance performance of an entire channel. For example, a first plug on one end of a modular plug cord may be tuned to perform at a low end of a defined range and a second plug on the other end of the modular plug cord tuned to perform at a high end of the defined range. In exemplary embodiments, the defined range relates to Category 5e, 6, 6A, and higher performance as defined by industry standards ANSI/TIA/EIA-568-B (/568) Commercial Building Telecommunications Cabling Standard and ISO/IEC 11801 (/11801). The tuning of plugs to achieve certain transmission performance is described in further detail in U.S. patent application publication 20040116081, the entire contents of which are incorporated herein by reference.

Assembly of the plug is described with reference to FIG. 1. An initial step involves inserting the plug contacts 106 into substrate 104 at plated through holes 114. The plug contacts 106 may have press fit tails, solder tails, compliant pin, mechanically secured tails, or other connection-types for establishing electrical and mechanical connection in plated through holes 114. The wire contacts 108 have tails that are placed through contact carrier 110 and into plated through holes 107 in substrate 104. The wire contacts 108 preferably have press-fit tails. The wire contacts 108 may establish electrical connection with wires 202 through an insulation displacement contact (IDC). Alternatively, the wire contacts 108 may be insulation piercing contacts (IPC) or solder terminals. These operations result in a subassembly as shown in FIG. 3.

Wires are then terminated to wire contacts 108 using known techniques. The subassembly of FIG. 3 may be partially inserted into plug housing 102 prior to wire termination. As noted above, the wire pairs 202 on each end of cable 200 need not be crossed or rearranged as the wire contacts 108 at each end of the cable 200 mirror the location of the wire pairs in cable 200. Once the wire pairs 202 are terminated to the wire contacts 108, the substrate 104 is slid into plug housing 102 so that plug contacts 106 align with slots 116. The substrate is secured in the housing 102 through a friction fit and/or through one or more latches that secure substrate 104.

In an alternate embodiment discussed herein, the wire contacts 108 are exposed when substrate 104 is fully inserted in housing 102. Wire pairs 202 are terminated to the wire contacts 108 as described above. A non-conductive strain relief member is then slid over the cable 200 and attached to the housing 102 to cover wire contacts 108.

Figure 9:
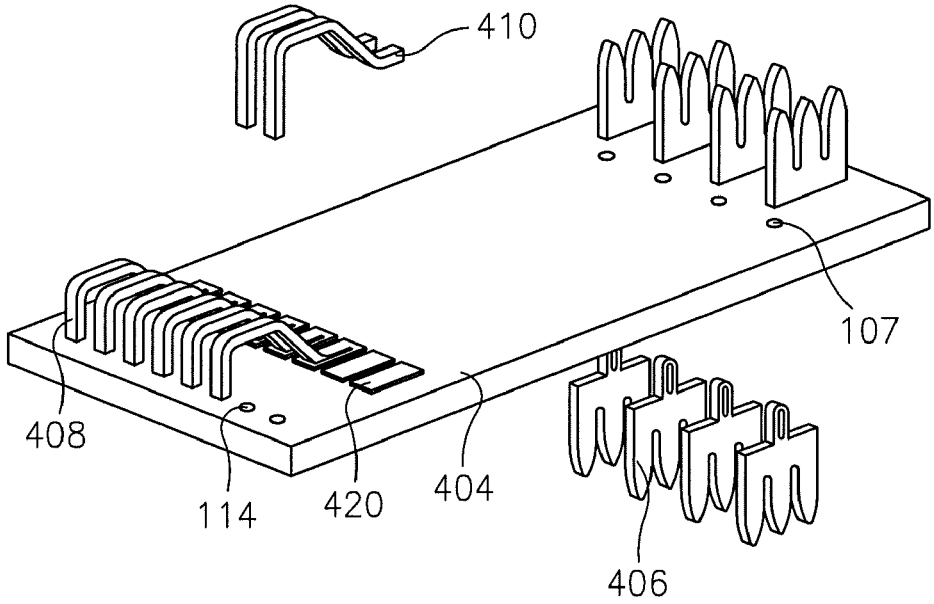
FIG. 9 illustrates an exemplary plug circuit board in alternate embodiments.

FIG. 9 illustrates an exemplary substrate 404 in alternate embodiments. Substrate 404 uses IPCs 406 for establishing electrical connection with wires 202. Plug contacts 408 are wire contacts including cantilevered arms extending from posts. The post end is positioned in a plated through hole 114 (e.g., soldered, press-fit). The arm extends rearward and includes a tab 410 that may make electrical connection with a pad 420. Plated through holes 114 may be in electrical connection with plated through holes 107. The pads 420 may be in electrical connection with plated through holes 107 receiving wire contacts 406. The pads 420 may be electrically connected to compensating elements (reactance, inductance, capacitance, phase control) on substrate 404 such that when the tab 410 contacts pad 420, the contact 408 is connected to the compensation element. Phase adjustment may be accomplished using techniques described in U.S. published patent application 20040147165, the entire contents of which are incorporated herein by reference. This arrangement allows selective compensation to one or more contacts 408 by establishing or prohibiting electrical connection between tab 410 and pad 420.

As noted above, instead of a substrate such as a PCB, the plug may utilize a lead frame design where the wire contacts 108 and plug contacts 106 are formed on common, metal leads. In this alternative, the locations of the wire contacts is similar to that shown in FIGS. 7 and 8 such that wire pairs do not need to be crossed to be terminated to the wire contacts at each end of the cable.

Embodiments of the invention allow the wire pairs to be terminated on the device from either end without crossing over a pair or having to split a pair as in the case of industry standard wiring schemes TIA-568A/TIA-568B. The plug contacts 106 may have non-standard profiles to increase performance and eliminate variability in height and location. The reduction in variability leads to a more consistent electrical performance. This also results in reduced cost, as less operator input is needed in the manufacture of the plug.

The above embodiments are described with reference to a plug. The wire termination may also be used with other connectors, such as modular outlets. As described above, the modular outlets include substrates such as those shown in FIGS. 5-8 or lead frames so that the locations of the wire contacts mirror the locations of the wire pairs on each end of the cable.

The plugs/outlets may be equipped with other components such as active/passive identification circuitry (e.g., RFID). Security chips may be added to plugs/outlets in embodiments of the invention as described in pending U.S. patent application Ser. No. 11/493,332, the entire contents of which are incorporated herein by reference. Further, plugs/outlets in embodiments of the invention may include tunable elements such as those described in U.S. patent application, serial number 11/485,210, the entire contents of which are incorporated herein by reference.

Embodiments of the invention provide for ease of termination of wires at the wire contacts without crossing wire pairs. This results in reduced variability and better transmission performance in the plug and the mated connector due to termination design. Reducing variability in wire termination results in reduced crosstalk and enhances the ability to compensate for crosstalk, as the crosstalk is more predictable.

Figure 10:
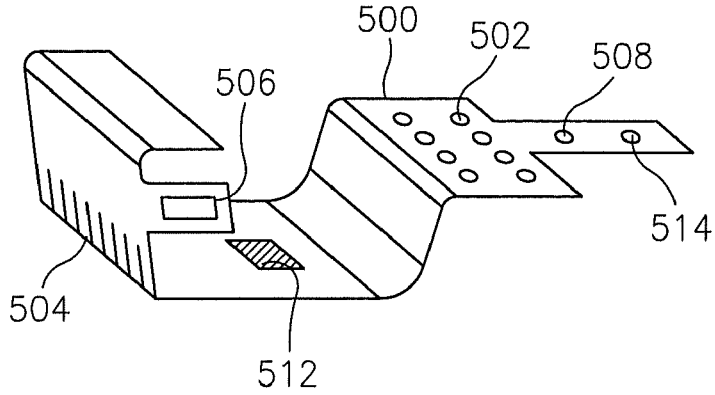
FIG. 10 illustrates a flexible circuit that may be used in embodiments of the invention.

FIG. 10 illustrates a flexible circuit that may be used in embodiments of the invention. In this embodiment a flex circuit 500 may be used instead of substrate 104 in the plug housing to make electrical connections. The flexible circuit 500 is supported within a plug housing. Wires 202 may make electrical connection with the flex circuit 500 at wire pads 502. The wires 202 may be soldered to wire pads 502. Alternatively, an IDC may be in electrical connection (e.g., press fit) with each wire pad 502 to make electrical connection with wires 202. The flex circuit 500 includes traces between wire pads 502 and plug contact pads 504. The plug contacts pads 504 may be placed in electrical contact with plug contacts 106 by soldering or press fit. Alternatively, the plug contact pads 504 may be aligned with slots in a plug housing so as to allow the plug contact pads 504 to engage outlet contacts when the plug is mated with an outlet.

Shield tabs 506 extend from the flexible circuit 500. Traces on the flex circuit 500 connect the shield tabs 506 to a shield pad 508. The shield pad 508 is placed in electrical connection with a shield on cable 200 (e.g., solder, IDC or other mechanical fastener). Shield tabs 506 are conductive and extend beyond plug housing to make electrical contact with a conductive outlet housing, thereby rendering ground continuity from cable 200, through the plug and into the outlet. The flex circuit 500 may be easily shielded by applying a foil (and any needed intermediate insulator) on each side of the flex circuit 500.

Additional conductive regions may be used for alternate connections. For example, connectivity region 512 is an exposed conductive region that may mate with a connectivity conductor on an outlet to detect plug-outlet connections. Traces on the flex circuit 500 electrically connect connectivity region 512 with a connectivity pad 514. The connectivity pad 514 on flex circuit 500 provides a location to make electrical contact (e.g., solder, IDC) with a wire in cable 200 for systems that use an additional conductor to transmit connectivity signals. The use of a flex circuit 500 reduces part count for the plug and provides additional space in the plug housing for shielding or other components.

Figure 11:
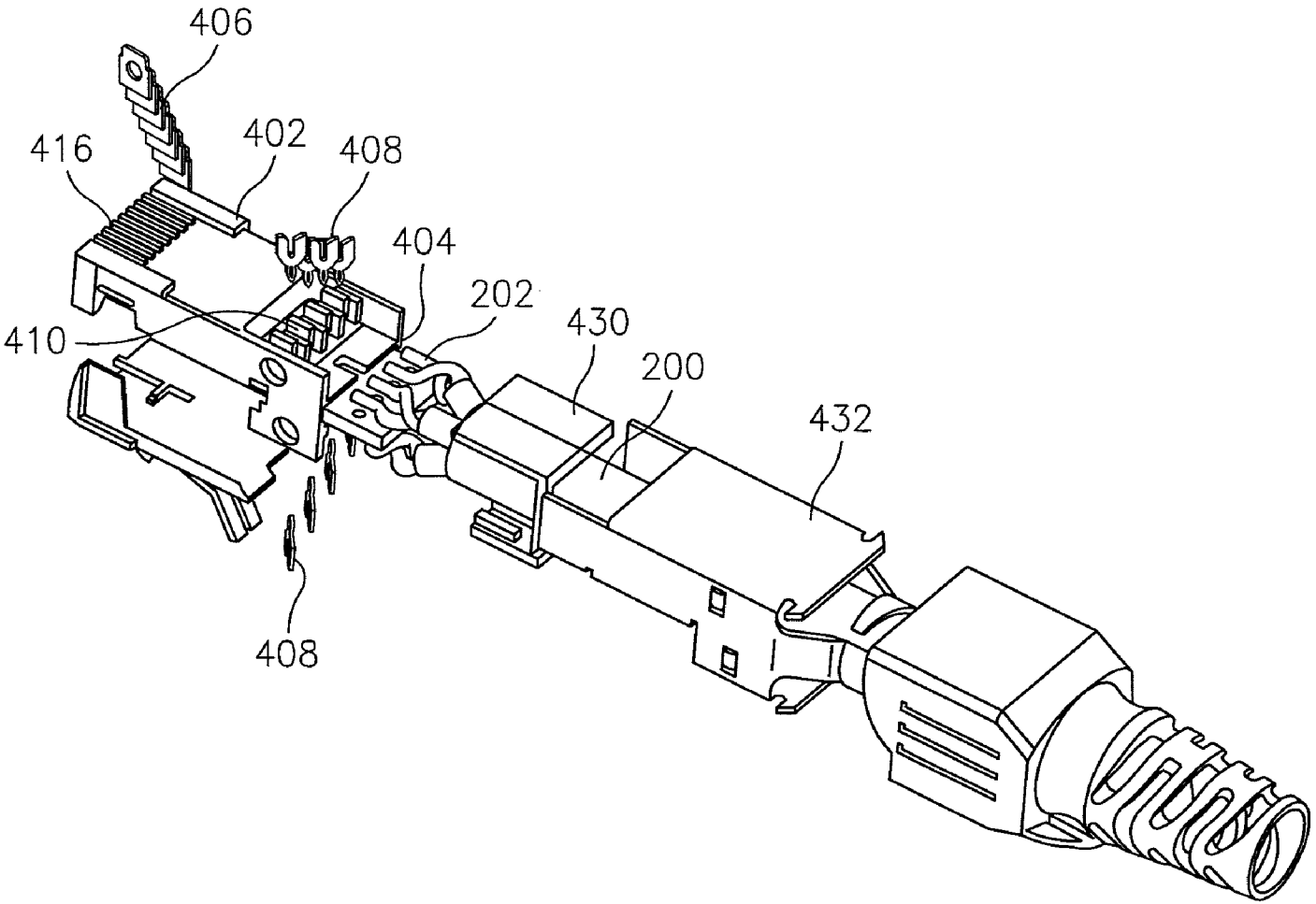
FIG. 11 is a perspective, exploded view of a plug in alternate embodiments.

FIG. 11 illustrates a plug 400 in alternate embodiments. Plug housing 402 contains a substrate 404 which establishes an electrical connection between plug contacts 406 and wire contacts 408. The wire contacts 408 may be positioned on a contact carrier 410 which, in this embodiment, is integral with the plug housing 402. The substrate 404 may be a printed circuit board, flexible circuit material, etc. having traces therein for establishing electrical connection between plug contacts 406 and wire contacts 408 as described above. Substrate 404 may include compensation elements for tuning electrical performance of the plug 400 (e.g., NEXT, FEXT, return loss, balance). In alternate embodiments, some or all of the plug contacts 406 and wire contacts 408 are part of a lead frame, eliminating the need for substrate 404.

Plug contacts 406 have press fit tails that are received in plated through holes in substrate 404. Traces on substrate 404 establish electrical connection between plated through holes and wire contacts 408. Plug contacts 406 extend through slots 416 in plug housing 402 to establish contact with outlet contacts (not shown) when plug 400 is mated with an outlet (not shown). In alternate embodiments, the plug contacts 406 are soldered in substrate 404. The plug contacts 406 may have press fit tails, solder tails, compliant pin, mechanically secured tails, or other connection-types for establishing electrical and mechanical connection in plated through holes.

Wire contacts 408 include press fit tails that extend through contact carrier 410 and engage plated through holes in substrate 404 beneath contact carrier 410. Four wire contacts 408 extend from a first surface of the substrate and four wire contacts 408 extend from a second surface of the substrate 404. As described above, the arrangement of the wire contacts on the substrate 404 allows the twisted wire pairs to be terminated to the wire contacts 408 without crossing wire pairs from their original position on either end of a modular plug cord or other assembly. Thus, the embodiment of FIG. 11 uses termination similar to that described with reference to FIGS. 5-8 and variants thereof.

An insulating isolation member 430 is positioned over wire contacts 408 to prevent the wire contacts 408 from contacting a conductive shield member 432. Conductive shield member 432 is made from a conductive material such as metal, metalized plastic, conductive plastic, etc.

While the invention has been described with reference to exemplary embodiments, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiments disclosed for carrying out this invention.

What is claimed is:

1. A telecommunications connector assembly comprising:

a cable having a first pair of twisted wires and a second pair of twisted wires;

a first connector having a first substrate having a first termination area, the first pair of twisted wires having a first end electrically terminated on a first side of the first substrate, the second pair of twisted wires having a first end electrically terminated on a second side of the first substrate, the second side opposite the first side;

a second connector having a second substrate having a second termination area, the second pair of twisted wires having a second end electrically terminated on the first side of the second substrate, the first pair of twisted wires having a second end electrically terminated on the second side of the second substrate, the second side opposite the first side.

2. The telecommunications connector assembly of claim 1 wherein:

the cable has a third pair of twisted wires and a fourth pair of twisted wires, the third pair of twisted wires having a first end electrically terminated on a first side of the first substrate, the fourth pair of twisted wires having a first end electrically terminated on a second side of the first substrate, the second side opposite the first side;

the third pair of twisted wires having a second end electrically terminated on the second side of the second substrate, the fourth pair of twisted wires having a second end electrically terminated on the first side of the second substrate, the second side opposite the first side.

3. The telecommunications connector assembly of claim 1 wherein:

the first pair of wires is electrically terminated on the first substrate at insulation displacement contacts.

4. The telecommunications connector assembly of claim 1 wherein:

the first pair of wires is electrically terminated on the first substrate at solder pads.

5. The telecommunications connector assembly of claim 1 wherein:

the first substrate is the same design as the second substrate.

6. The telecommunications connector assembly of claim 5 wherein:

the first substrate and the second substrate have conductive traces in a same pattern.

7. The telecommunications connector assembly of claim 1 wherein:

the first substrate is different from the second substrate.

8. The telecommunications connector assembly of claim 7 wherein:

the first substrate and the second substrate have conductive traces in different patterns.

9. The telecommunications connector assembly of claim 1 wherein:

the substrate is a printed circuit board.

10. The telecommunications connector assembly of claim 1 wherein:

the first connector is tuned to establish a first transmission level in a defined range, the second connector is tuned to establish a second transmission level in the defined range, the second level being different than the first level.

11. The telecommunications connector assembly of claim 1 wherein:

the first connector is a plug and the second connector is a plug.

12. The telecommunications connector assembly of claim 11 further comprising:

first plug contacts installed in the first substrate, the first plug contacts engaging outlet contacts upon the plug mating with a modular jack.

13. The telecommunications connector assembly of claim 12 wherein:

the first plug contacts are wire contacts having a post contacting the substrate and an arm extending from the post.

14. The telecommunications connector assembly of claim 1 wherein:

the first connector is an outlet.

15. The telecommunications connector assembly of claim 1 wherein:

the first pair of twisted wires and a second pair of twisted wires have conductors within a range of 27 AWG to 22 AWG.

16. The telecommunications connector assembly of claim 1 wherein:

the first substrate includes conductive traces arranged to control transmission performance.

17. A telecommunications connector assembly comprising:

a cable having a first pair of twisted wires and a second pair of twisted wires;

a first connector having a first termination area, the first pair of twisted wires having a first end electrically terminated on a first side of the first termination area, the second pair of twisted wires having a first end electrically terminated on a second side of the first termination area, the second side opposite the first side;

a second connector having a second termination area, the second pair of twisted wires having a second end electrically terminated on the first side of the second termination area, the first pair of twisted wires having a second end electrically terminated on the second side of the second termination area, the second side opposite the first side.

18. The telecommunications connector assembly of claim 17 wherein:

the cable has a third pair of twisted wires and a fourth pair of twisted wires;

the third pair of twisted wires having a first end electrically terminated on a first side of the first termination area, the fourth pair of twisted wires having a first end electrically terminated on a second side of the first termination area, the second side opposite the first side;

the third pair of twisted wires having a second end electrically terminated on the second side of the second termination area, the fourth pair of twisted wires having a second end electrically terminated on the first side of the second termination area, the second side opposite the first side.

19. The telecommunications connector assembly of claim 17 wherein:

the first connector is tuned to establish a first transmission level in a defined range, the second connector is tuned to establish a second transmission level in the defined range, the second level being different than the first level.

* * * * *